US009670661B1

(12) United States Patent
Trepanier et al.

(10) Patent No.: US 9,670,661 B1
(45) Date of Patent: Jun. 6, 2017

(54) METHOD OF ASSEMBLING PANELS, ELONGATED RAIL AND RAIL AND CAP ASSEMBLY FOR ASSEMBLING PANELS

(71) Applicant: SOJAG INC., Brossard (CA)

(72) Inventors: Michel Trepanier, Montreal (CA); Yves Gagne, Mont-St-Hilaire (CA)

(73) Assignee: SOJAG INC., Brossard (CA)

( * ) Notice: Subject to any disclaimer, the term of this patent is extended or adjusted under 35 U.S.C. 154(b) by 0 days.

(21) Appl. No.: 15/054,182

(22) Filed: Feb. 26, 2016

(51) Int. Cl.

| | |
|---|---|
| ***E04B 1/61*** | (2006.01) |
| ***E04C 2/38*** | (2006.01) |
| ***E04B 5/02*** | (2006.01) |
| ***E04C 3/00*** | (2006.01) |

(52) U.S. Cl.
CPC ..... *E04B 1/61* (2013.01); *E04C 2/38* (2013.01); *E04C 2/50* (2013.01); *E04C 3/00* (2013.01)

(58) Field of Classification Search
CPC ..... E04B 1/61; E04C 3/00; E04C 2/50; E04C 2/38; Y10S 52/17; E04D 2003/0875; E04D 3/08; A01G 9/14
USPC ..... 52/90.1, 91.1, 92.1, 92.3, 93.2, 204.53, 52/204.54, 204.593, 204.597, 460, 461, 52/465, 469, 582.2, DIG. 17
See application file for complete search history.

(56) References Cited

U.S. PATENT DOCUMENTS

| | | | | |
|---|---|---|---|---|
| 5,363,615 | A * | 11/1994 | Christopher | E04B 1/0046 52/204.593 |
| 6,112,493 | A * | 9/2000 | Rickman | E04B 1/0046 52/461 |
| 6,347,495 | B1 * | 2/2002 | Conterno | E04C 2/543 248/223.41 |
| 6,553,739 | B2 * | 4/2003 | Richardson | E04D 3/08 52/204.71 |
| 7,017,307 | B2 * | 3/2006 | Jones | E04B 7/063 52/200 |
| 2004/0111985 | A1 * | 6/2004 | Back | E04B 7/04 52/90.1 |

* cited by examiner

*Primary Examiner* — Brian Glessner
*Assistant Examiner* — Adam Barlow
(74) *Attorney, Agent, or Firm* — BCF LLP

(57) ABSTRACT

A method of assembling panels, an elongated rail, and a rail and cap assembly for assembling panels are disclosed. A one-piece elongated rail comprises a bottom, a pair of sides extending from the bottom, a pair of walls located between the sides and perpendicular to the bottom, and a central channel floor extending between the parallel walls and parallel to the bottom. A central channel is formed between the walls and delimited by the central channel floor. Two lateral channels are each formed between one of the sides and one of the walls. The assembly includes the rail and a cap, the cap having a top and an opposite projection configured for insertion in the central channel of the rail. The rail and the cap may be made by extrusion. The method involves adjoining panels to the rail and mounting the cap thereon.

14 Claims, 6 Drawing Sheets

METHOD OF ASSEMBLING PANELS, ELONGATED RAIL AND RAIL AND CAP ASSEMBLY FOR ASSEMBLING PANELS

TECHNICAL FIELD

The present disclosure relates to the field of light structures. More specifically, the present disclosure relates to a method of assembling panels, an elongated rail and a rail and cap assembly for assembling panels.

BACKGROUND

Light structures sold as kits are popular due in part to their advantages in terms of cost, availability, aesthetics, and ease of assembly by consumers. Non-limiting examples of such structures include pavilions, sun shelters, gazebos, solariums, garden sheds and the like. These structures are usually made of metal such as light steel, aluminum, strong plastics such as acrylonitrile butadiene styrene (ABS) or polyvinyl chloride (PVC) or combinations of such materials.

An example of such a light structure is shown on FIG. 1, which is a perspective view of a sun shelter made by Sojag™ of Brossard, Quebec, Canada. A shelter 10 comprises a roof 12 supported by four (4) legs or pillars 14. The roof 12 is constructed of a four (4) peripheral beams 16 (two of which are shown), panels 18 of various shapes and sizes, and a top ridge 20. Several elongated rails 22 lead from the beams 16 to the top ridge 20 and maintain the panels 18 in place. Elongated and narrow plates (not shown) located underneath the roof 12 may be fastened to the rails 22, at a right angle therewith, to provide greater stability to the structure.

FIG. 2 is a front elevation view of a conventional single-piece rail. The rail 22 as introduced in the description of FIG. 1 is shown in front elevation. It has a generally constant cross-section, so the front elevation view of FIG. 2 equally represents the cross-section the rail 22 at other points along its length. Only a top surface 24 of the rail 18 is visible on FIG. 1; a bottom surface 26 would be visible from underneath the roof 12 of the shelter 10. Within the rail 22, generally hidden from view, internal braces 28 transmit and distribute loading charges that may be applied on the roof 10, for example as a result of snow accumulation, between the top and bottom surfaces 24 and 26 of the rail 22. On each side of the rail 22, an opening 30 is provided for insertion of side edges of the panels 18 when assembling the shelter 10. Hooks 32 are provided on each outer edge of the rail 22 for insertion of strips (not shown) used as water guards pressing against the edges of the panels 18.

As may be understood from a consideration of FIG. 1, two (2) or more panels may take place within a perimeter formed of the ridge 20, a pair of rails 22 and one of the beams 16. In an overlap area 34, a lower end of a first panel 18 located closer to the ridge 20 would extend slightly over an upper end of a second panel 18 located closer to the beam 16 so that rain falling on the roof 12 would not penetrate between these panels. Consequently, the openings 30 of the rail 22 need to accommodate twice the thickness of the panels 18 since this double thickness needs to be accommodated in the overlap area 34.

However, if the openings 30 are too narrow, assembly of the roof 12 will be difficult, require application of significant force to the panels 18, leading to possible damage. If the openings 30 are too wide, small unsightly gaps may remain visible between the panels 18 and the panels 18 may tend to move after the shelter 10 has been fully assembled.

Therefore, there is a need for improved techniques for assembling light structures.

SUMMARY

According to the present disclosure, there is provided a one-piece elongated rail for assembling panels. The rail comprises a bottom, a pair of sides extending from the bottom, a pair of walls located between the sides and perpendicular to the bottom and a central channel floor extending between the parallel walls and parallel to the bottom. A central channel is formed between the walls and is delimited by the central channel floor. A pair of lateral channels is included, each lateral channel being formed between one of the sides and one of the walls.

According to the present disclosure, there is also provided an assembly comprising the above described rail and an elongated cap. The cap includes a top and a projection. A width of the top is at least equal to a width of the rail. The projection extends underneath the top and is adapted for insertion within the central channel of the rail.

The present disclosure further relates to a method of assembling panels. The above rail and cap assembly is provided. At least one panel is installed on each side of the rail so that a lateral edge of each panel reaches over a corresponding lateral channel of the rail. The cap is mounted on the rail by inserting the projection of the cap within the central channel of the rail. At least one screw is installed through the bottom and the central channel floor of the rail and through a bottom face of the projection.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Various aspects of the present disclosure generally address one or more of the problems related to the assembly of light structures. The following passages will describe various embodiments of a lower rail and rail assembly usable to construct pavilions, sun shelters, gazebos, solariums, garden sheds and similar structures. It will be understood that uses the present technology is not limited to constructing roofs for such structures. The present technology may be applied in constructing other parts of various structures, whether light or heavy, whether the structures are for indoor or outdoor uses.

An elongated lower rail as disclosed herein can be used in relation with an elongated cap to assemble panels, for example flat and thin panels. The lower rail has a central channel and a pair of lateral channels. The cap has a projection adapted for insertion in the central channel of the lower rail. The panels are positioned alongside the lower rail, a lateral edge of each channel reaching over one of the lateral channels. When necessary, two or more panels may overlap at least in part over a lateral channel of the lower rail. When the panels are properly installed, the cap is positioned on the lower rail by placing its projection within the central channel.

Figure 3:
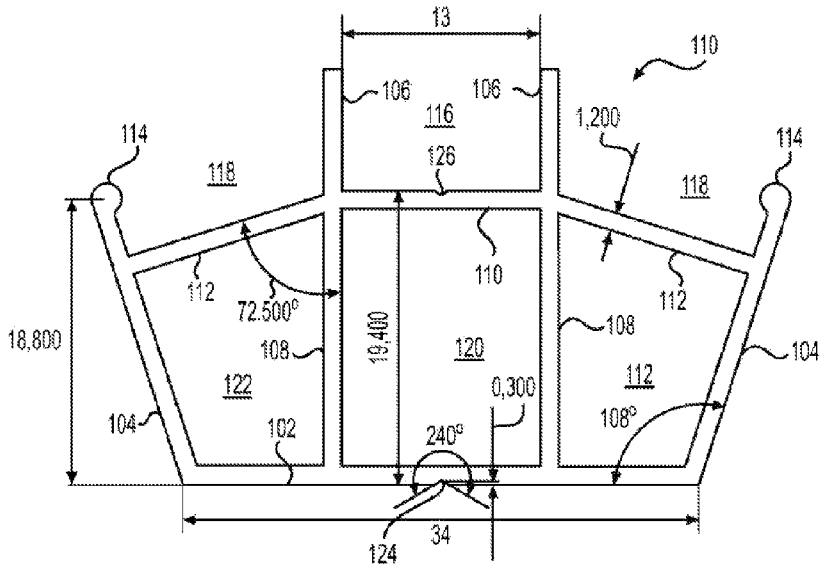
FIG. 3 is a front elevation view of a lower rail according to a first embodiment.

Referring now to the drawings, FIG. 3 is a front elevation view of a lower rail according to a first embodiment. A lower rail 100 may be fabricated, for example, by aluminum extrusion, by extrusion of a plastic material, for example (ABS), or using a similar manufacturing method. The lower rail 100 may extend over a length sufficient for it intended use, for example between one meter and several meters in length. The lower rail 100 has a generally constant cross-section, so the front elevation view of FIG. 3 equally represents the cross-section the lower rail 100 at other points along its length. Otherwise stated, the shape of the lower rail 100 as seen in the front elevation view of FIG. 3 corresponds to the shape of a mold (not shown) used in an extrusion process for manufacturing the lower rail 100.

On FIG. 3, a lower rail 100 comprises a bottom 102, a pair of angled sides 104, a pair of vertical walls 106, a pair of internal vertical walls 108, a central channel floor 110 and a pair of lateral channel floors 112. In an embodiment, each of the vertical walls 106 is co-aligned with a corresponding internal vertical wall 108 in order to transmit loading charges applied on the top of the vertical walls 106 through the internal vertical walls 108 down to the bottom 102. The angled sides 104 are angled so that the general width of the lower rail 100 is broader at its top, away from the bottom 102. A variant in which the sides 104 are vertical and parallel to the walls 106 and 108 is also contemplated. Each of the angled sides 104 reach the bottom 102 at their lower extremities and end with a rib 114 at their upper extremities. A generally U-shaped central channel 116 is defined between the vertical walls 106 and the central channel floor 110. The central channel 116 is open at its upper end. Lateral channels 118 are defined, on each side of the central channel 116, between respective ones of the angled sides 104, vertical walls 106 and lateral channel floors 112. The lateral channels 118 are also open at their upper ends; they may be used as conduits for rainwater in some applications. A generally rectangular cavity 120 is defined between the bottom 102, the internal vertical walls 108 and the central channel floor 110. Quadrilateral cavities 122 are defined, on each side of the lower rail 100, between the bottom 102, one of the angled sides 104 and one of the internal vertical walls 108. Grooves 124 and 126 may be cut, respectively, into the bottom 102 and the central channel floor 110. As will be described hereinbelow, apertures may be cut into the bottom 102 and the central channel floor 110 for installing screws therethrough. The grooves 124 and 126 facilitate the alignment of a drilling tool for cutting such apertures.

On FIG. 3, dimensions are in millimeters, except for angles that are in degrees; these dimensions are presented as examples and do not limit the present disclosure. For greater certainly, it should be understood that relative dimensions between the various components shown on FIG. 3, as well as angles between these components, are solely for illustration purposes.

Figure 4A:
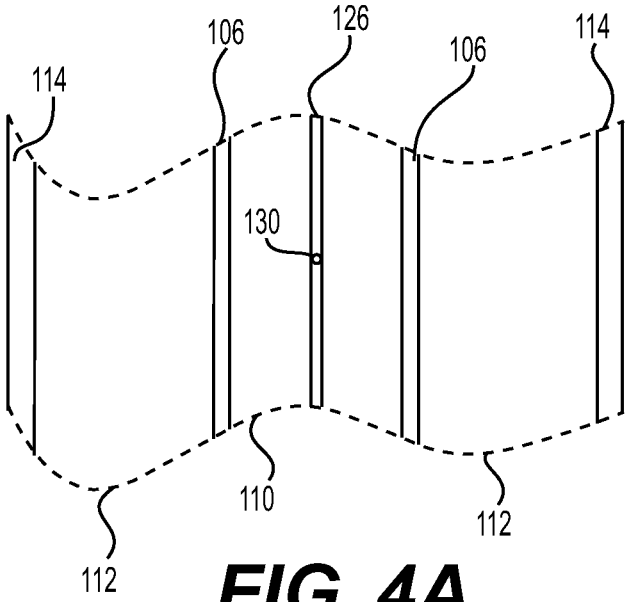
FIGS. 4*a* and 4*b* are, respectively, sectional views top and bottom of the lower rail of FIG. 3.
Figure 4B:
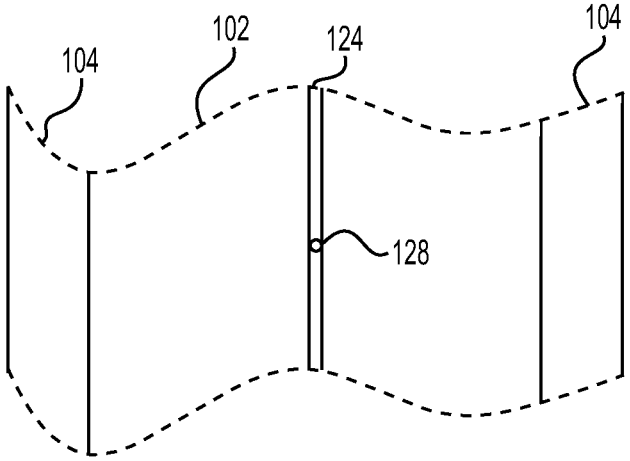

In an embodiment, each of the above-described components of the lower rail 100 is elongated and extends linearly along a length of the lower rail. FIGS. 4*a* and 4*b* are, respectively, sectional views top and bottom of the lower rail of FIG. 3. Same reference numerals are used in FIGS. 4*a* and 4*b* as in FIG. 3 to show the same features. FIGS. 4*a* and 4*b* further show apertures 128 and 130 respectively cut into the grooves 124 and 126 for installation of screws (not shown). Cutting of the apertures 128 and 130 may for example take place at the time of manufacturing of the lower rail 100.

Figure 5:
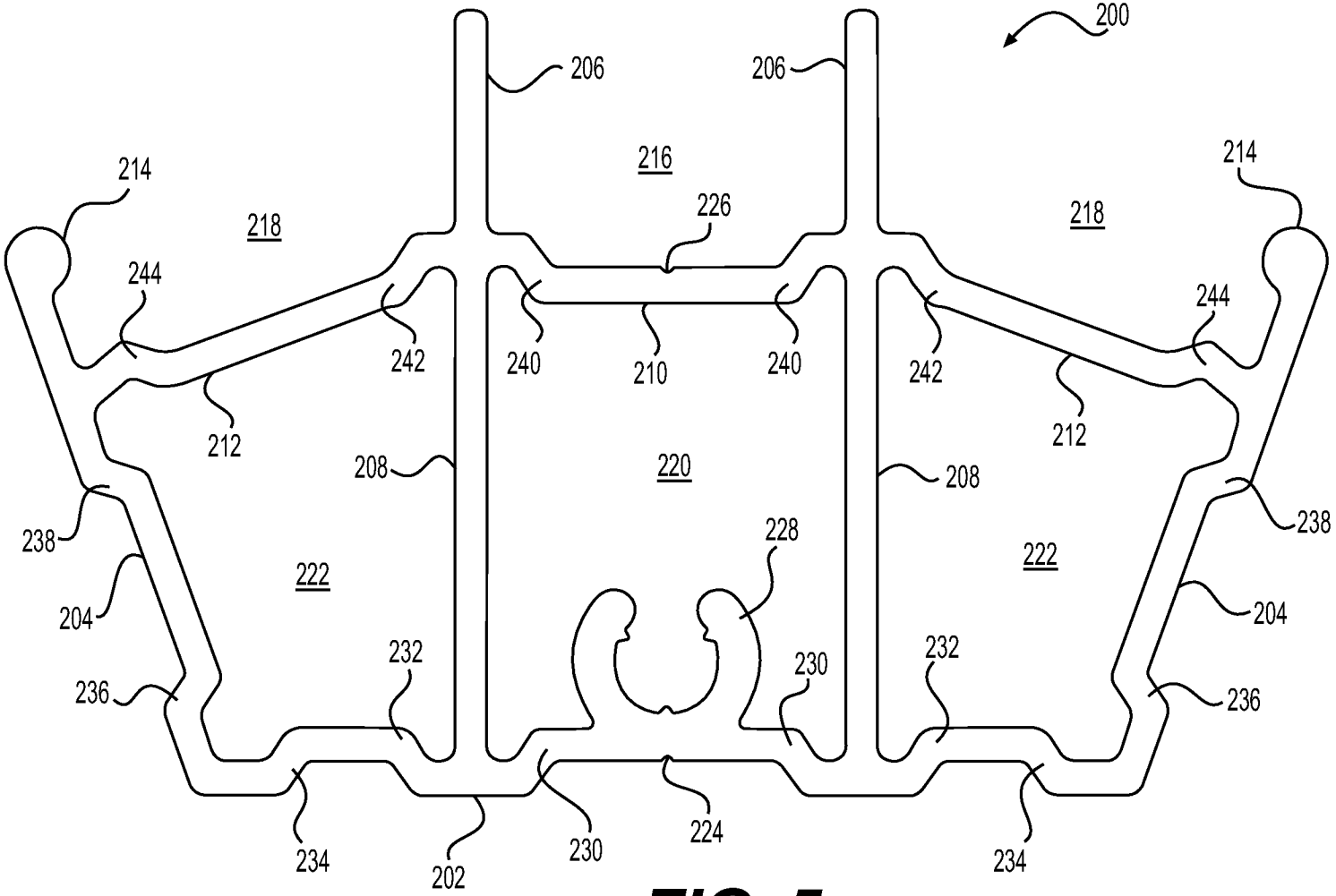
FIG. 5 is a front elevation view of a lower rail according to a second embodiment.
Figure 6:
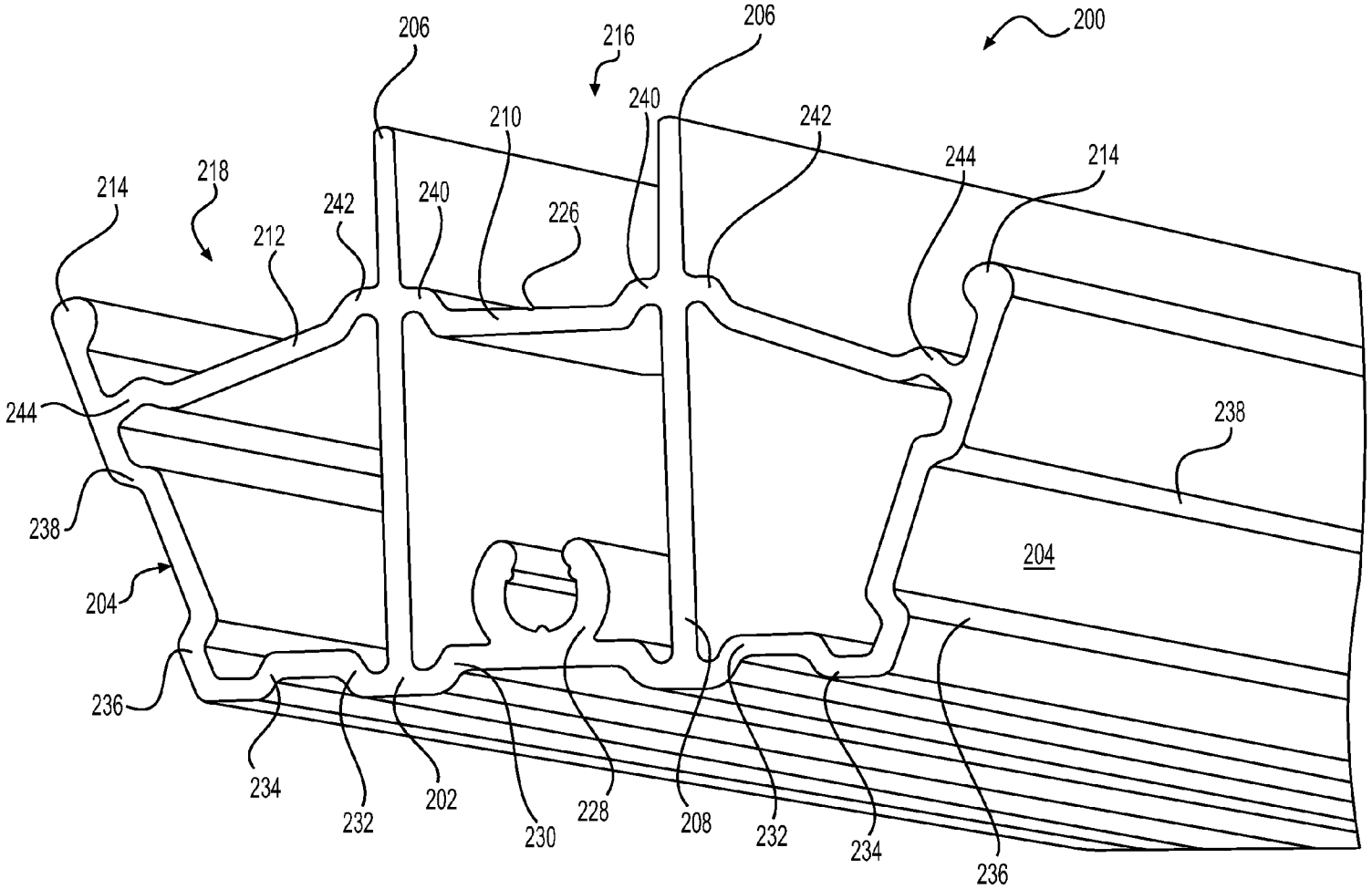
FIG. 6 is a perspective view of the lower rail of FIG. 5.

FIG. 5 is a front elevation view of a lower rail according to a second embodiment. A lower rail 200 may be fabricated in the same or equivalent manner as the lower rail 100, using the same or similar materials, and may be have the same or similar dimensions. When compared to the first embodiment of FIG. 3, the lower rail 200 further includes a plurality of ridges and a screw port, as will be described in the following paragraphs. Some of these features may be further appreciated by consideration of FIG. 6, which is a perspective view of the lower rail of FIG. 5.

The lower rail 200 comprises a bottom 202, a pair of angled sides 204, a pair of vertical walls 206, a pair of internal vertical walls 208, a central channel floor 210 and a pair of lateral channel floors 212. In an embodiment, each of the vertical walls 206 is co-aligned with a corresponding internal vertical wall 208 in order to transmit loading charges applied on the top of the vertical walls 206 through the internal vertical walls 208 down to the bottom 202. The angled sides 204 are angled so that the general width of the lower rail 200 is broader at its top, away from the bottom 202. As in the case of the lower rail 100, the sides 204 may alternatively be parallel to the walls 206 and 208. Each of the angled sides 204 reach the bottom 202 at their lower extremities and end with a rib 214 at their upper extremities. A generally U-shaped central channel 216 is defined between the vertical walls 206 and the central channel floor 210. The central channel 216 is open at its upper end. Lateral channels 218 are defined, on each side of the central channel 216, between respective ones of the angled sides 204, vertical walls 206 and lateral channel floors 212. The lateral channels 218 are also open at their upper ends; they may be used as conduits for rainwater in some applications. A generally rectangular cavity 220 is defined between the bottom 202, the internal vertical walls 208 and the central channel floor 210. Generally quadrilateral cavities 222 are defined, on each side of the lower rail 200, between the bottom 202, one of the angled sides 204 and one of the internal vertical walls 208. Grooves 224 and 226 may be cut, respectively, into the bottom 202 and the central channel floor 210 to facilitate the alignment of a drilling tool for cutting screw apertures.

The lower rail 200 includes a screw port 228 located on an internal face of the bottom 202, within the cavity 220. The screw port 228 is configured to receive a screw (not shown) for mounting an extremity of the lower rail 200 to a plate of like object (not shown). In one variant, the screw port 228 may be present at each extremity of the lower rail 200. In another variant, especially but not exclusively when the lower rail 200 is manufactured using an extrusion process, the screw port 228 may extend along a complete length of the lower rail 200. It may be observed that a screw port such as the screw port 228 may be added to the lower rail 100 of FIG. 3.

In the embodiment of FIG. 5, the bottom 202, the angled sides 204, the central channel floor 210 and the lateral channel floors 212 are modified when compared to equivalent components of the lower rail 100 of FIG. 3 by the addition of ridges, or folds, in the material forming those components. In the embodiment of FIG. 3, the bottom 202 is folded within the cavity 220 at ridges 230 and within the cavities 222 at ridges 232 and 234. The angled side walls 204 are folded at ridges 236 and 238. The central channel floor 226 is folded at ridges 240. The lateral channel floors 212 are folded at ridges 242 and 244. Folding the material forming the lower rail 200 at the various ridges triangulates the shape of its various sections and provides a better resistance and yield strength.

Various embodiments of the lower rail 200 may include some, but not all of the ridges 230, 232, 234, 236, 238, 240, 242 and 244. It may be observed that a variant of the lower rail 200 may include some or all of the ridges 230-244 while excluding the screw port 228.

FIGS. 7*a*, 7*b*, 7*c* and 7*d* illustrate an assembly method using the lower rail of FIG. 3 or the lower rail of FIG. 5. The same method may be employed, whether the lower rail 100 of FIG. 3 or the lower rail 200 of FIG. 5 is used. The lower rail 100 or 200 may be assembled with a cap 300 to hold panels, such as the panels 18 of FIG. 1. The lower rail 100 or 200 would first be installed, followed by the installation of the panels 18 and then by installation of the cap 300. Screws (not shown) may be inserted from underneath the lower rail 100 or 200, to solidly join the lower rail 100 or 200 with the cap while holding the panels 18 in place.

Figure 7A:
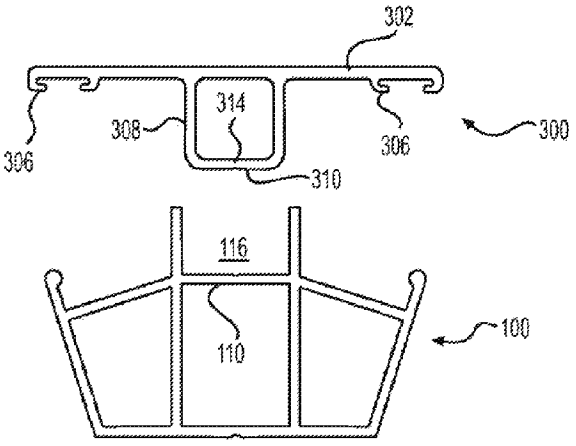
FIGS. 7*a*, 7*b*, 7*c* and 7*d* illustrate an assembly method using the lower rail of FIG. 3 or the lower rail of FIG. 5.
Figure 7B:
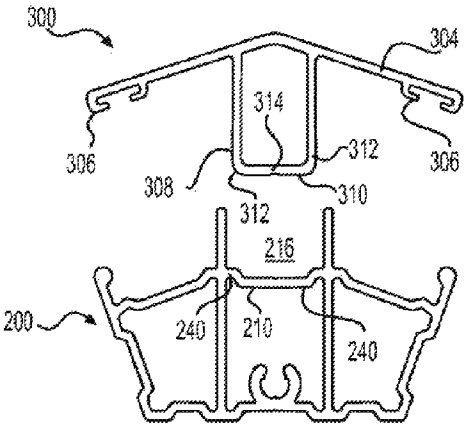
Figure 7C:
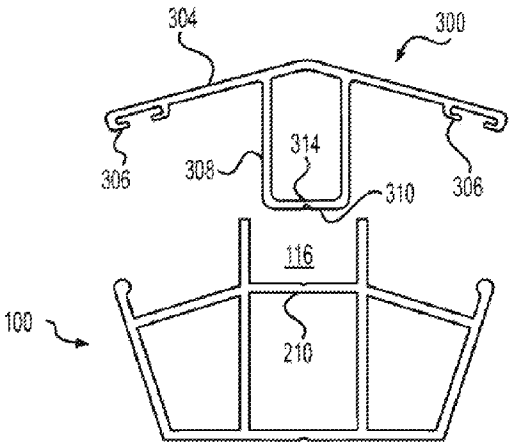

The cap 300 is shown in front elevation views in FIGS. 7*a*, 7*b* and 7*c*, in two (2) distinct variants. The cap 300 is adapted to mate with the lower rail 100 or with the lower rail 200. The cap 300 shown on FIGS. 7*a*, 7*b* and 7*c* may be fabricated of the same material as the lower rail 100 or 200, for example, by aluminum extrusion, by extrusion of a plastic material, for example (ABS), or using a similar manufacturing method. The cap 300 may extend over substantially the same length as the lower rail 100 or 200. The cap 300 may extend beyond the lower rail 100 or 200 by a small margin in order to prevent rain, snow or debris from entering into the channels of the lower rail 100 or 200. It is also possible to longitudinally assemble, for example, two (2) lower rails 100 or 200 positioned end-to-end, and to use a cap 300 having a length covering the complete lower rail assembly. The cap 300 has a generally constant cross-section, so the front elevation views of FIGS. 7*a*, 7*b* and 7*c* equally represent the cross-section of the cap 300 at other points along its length.

The cap 300 may have a flat top 302 or a bent top 304. Hooks 306 for insertion of strips (not shown) used as water guards are provided at each extremity of the cap 300, underneath the top 302 or 304.

Figure 7D:
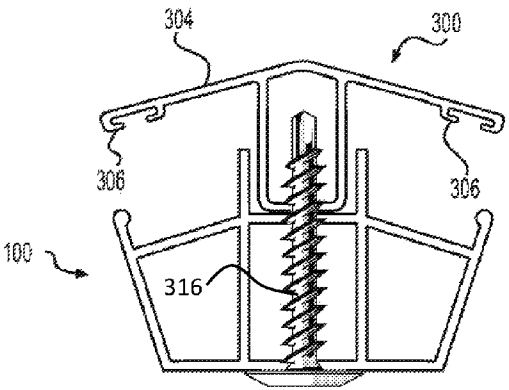

A projection 308 is centrally located underneath the top 302 or 304. Like other components of the cap 300, the projection 308 may extend along a length of the cap 300. The projection 308 is adapted to be inserted within the central channel 116 or 216 of the lower rail 100 or 200. When used with the lower rail 100, a bottom face 310 of the projection 308 may abut on the central channel floor 110. When used with the lower rail 200, edges 312 of the bottom face 310 may abut on the ridges 240 of the central channel floor 210. However, depending on the thickness of panels being held between the cap 300 and the lower rail 100 or 200, a gap may remain between the bottom face 310 and the central channel floor 110 or 210. A groove 314 may be cut in the bottom face 310 of the projection 308 to facilitate the alignment of a drilling tool for cutting screw apertures, these apertures being aligned with apertures such as 128 and 130 of the lower rail 100 or with similar apertures of the lower rail 200. In the example of FIG. 7*d*, a screw 316 is installed through the bottom of the lower rail 100, through the central channel floor 210 and through the bottom face 310 of the projection 308.

Figure 1:
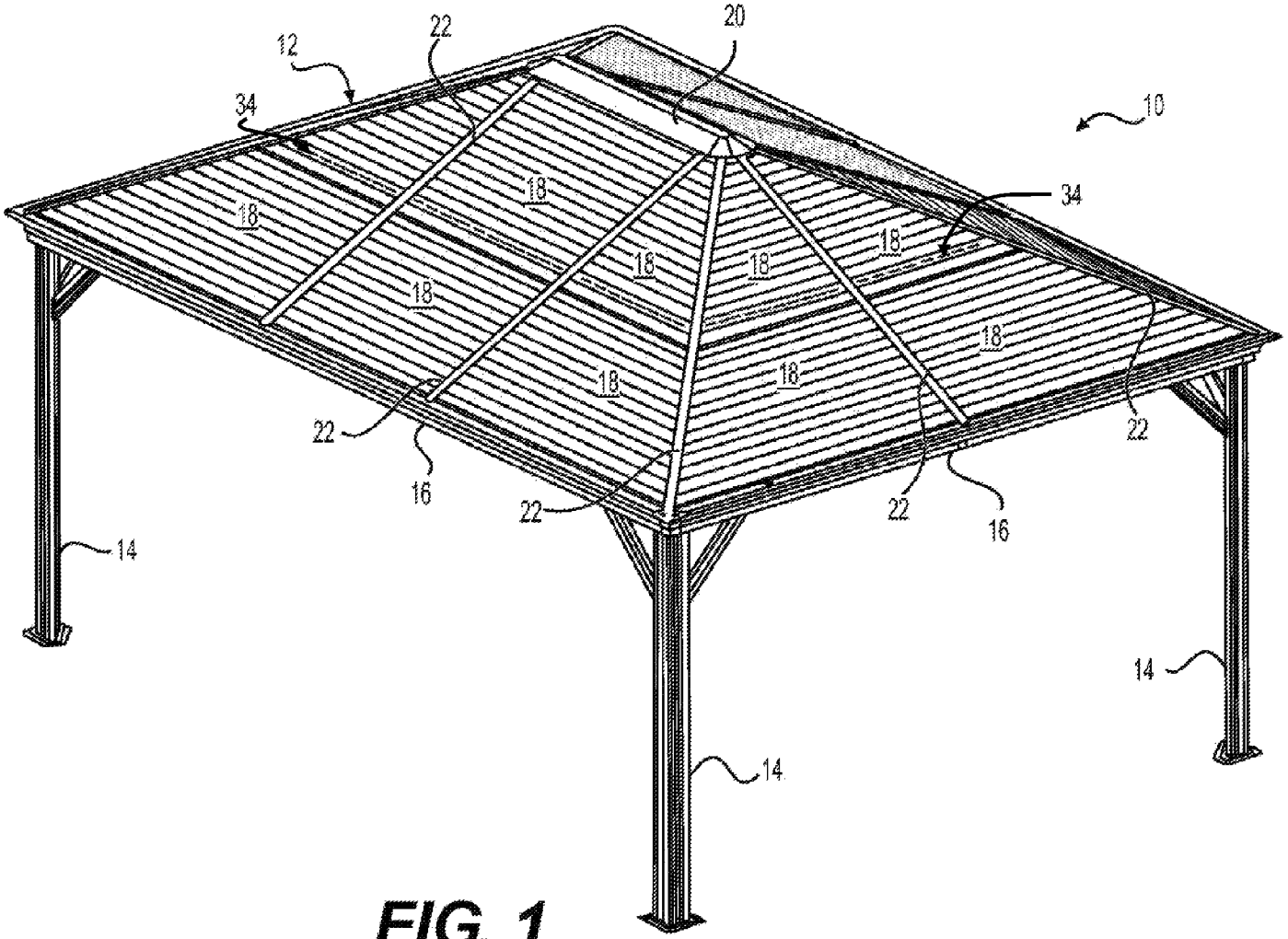
FIG. 1 is a perspective view of a sun shelter.
Figure 2:
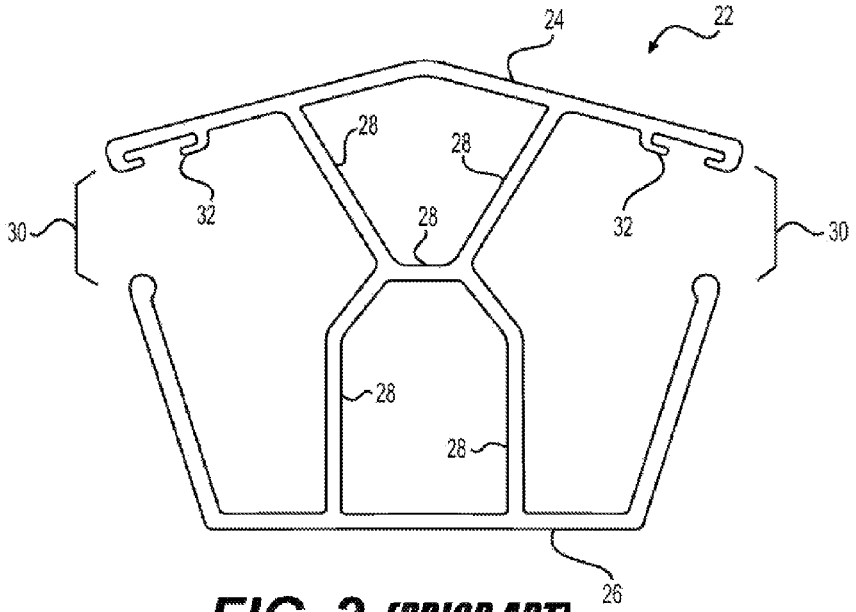
FIG. 2 (PRIOR ART)
FIG. 2 is a front elevation view of a conventional single-piece rail.

The shelter 10 introduced in the description of FIG. 1 has been modified by replacing the rails 22 with embodiments of the lower rails 100 and 200 in combination with the cap 300. Two instances of the shelter 10 as shown on FIG. 1 were built, one instance being built using lower rails 100 and the other instance being built with lower rails 200. All elements of the shelter 10, other than the lower rails 100 or 200, were identical and as described hereinabove. The beams 16 of the shelter 10 formed a perimeter of 10 by 12 feet. The roof 12 had a 44.5% slope. Both lower rails 100 and 200 were constructed of the same extruded aluminum alloy and had the same general dimensions and thickness. The lower rails 100 and 200 both included screw ports used to attach the lower rails 100 or 200 at one end to the ridge 20 and at the other end to the beams 16. In the case of the lower rail 100, a screw port similar to the screw port 228 was welded at each extremity. In the case of the lower rail 200, the screw port 228 extended along the length of the lower rail 200, an extrusion mold used to manufacture the lower rail 200 being shaped to form the screw port 228. The tests consisted of loading the roof 12 of the shelter 10 by adding 10 KG sand bags until the structure collapsed from a tearing of the lower rails 100 or 200. Using the lower rail 100, the roof collapsed under a 1460 KG load. Using the lower rail 200, the roof collapsed under a 2490 KG load.

It will be understood that the above description of rails has been provided with reference to "lower rails" for ease of illustration. Those of ordinary skill in the art will appreciate that the rails as disclosed herein may advantageously be used to assemble vertical structures, such as walls, in which the panels, the caps and the rails, as well as all components of the rails, would be vertical. Mentions of "horizontal", "vertical", "lower" and "upper" are therefore to be understood in the relative sense and do not limit the present disclosure.

Those of ordinary skill in the art will realize that the description of the method of assembling panels, of the elongated rail, and of the rail and cap assembly are illustrative only and are not intended to be in any way limiting. Other embodiments will readily suggest themselves to such persons with ordinary skill in the art having the benefit of the present disclosure. Furthermore, the disclosed method of assembling panels, elongated rail, and rail and cap assembly may be customized to offer valuable solutions to existing needs and problems of assembling light structures.

In the interest of clarity, not all of the routine features of the implementations of the method of assembling panels, elongated rail, and rail and cap assembly are shown and described. It will, of course, be appreciated that in the development of any such actual implementation of the method of assembling panels, elongated rail, and rail and cap assembly, numerous implementation-specific decisions may need to be made in order to achieve the developer's specific goals, such as compliance with application-, system-, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of light structures having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. A one-piece elongated rail for assembling panels, comprising:

a bottom;

a pair of sides extending from the bottom;

a pair of walls located between the sides and perpendicular to the bottom;

a central channel floor extending between the parallel walls and parallel to the bottom;

a central channel formed between the walls and delimited by the central channel floor;

a pair of lateral channels, each lateral channel being formed between one of the sides and one of the walls; and a pair of lateral channel floors further delimiting the lateral channels, each lateral channel floor being defined between one of the sides and one of the walls;

wherein:

each wall is separated in two sections at a junction of one of the lateral channel floors with the central channel floor, the central channel being formed between upper sections of the walls;

lower sections of the walls define a generally rectangular cavity of the rail with the central channel floor and with the bottom; and generally quadrilateral cavities of the rail are defined by the bottom, the lateral channel floors, the sides and the lower sections of the walls.

2. The rail of claim 1, wherein the lateral channel floors are angled so that their ends reaching the sides are lower than their opposite ends reaching the walls.

3. The rail of claim 1, comprising a screw port located on an internal face of the bottom and within the rectangular cavity.

4. The rail of claim 1, wherein the sides extend from the bottom at an angle so that the rail is narrower at its bottom than at its opposite end.

5. The rail of claim 1, wherein each side terminates with a rib at its end opposite from the bottom.

6. The rail of claim 1, wherein ridges are formed in at least one of the bottom, sides and central channel floors.

7. The rail of claim 1, wherein ridges are formed in at least one of the bottom, sides, central channel floors and lateral channel floors.

8. The rail of claim 1, wherein the rail is formed by an extrusion process.

9. The rail of claim 1, wherein the rail has a constant cross-section along its length.

10. An assembly, comprising:

the rail of claim 1; and an elongated cap, the cap including:

a top, a width of the top being at least equal to a width of the rail; and a projection extending underneath the top, the projection being adapted for insertion within the central channel of the rail.

11. The assembly of claim 10, wherein the cap further comprises a pair of hooks located underneath the top, on each side of the projection.

12. A method of assembling panels, comprising:

providing the assembly of claim 10;

installing at least one panel on each side of the rail, a lateral edge of each panel reaching over a corresponding lateral channel of the rail;

mounting the cap on the rail by inserting the projection of the cap within the central channel of the rail; and installing at least one screw through the bottom and the central channel floor of the rail and through a bottom face of the projection.

13. The method of claim 12, comprising installing a plurality of panels on at least one side of the rail, the panels overlapping at least in part over the corresponding lateral channel of the rail.

14. The method of claim 12, comprising cutting pluralities of apertures in the rail and in the cap for installation of a corresponding plurality of screws.

* * * * *